US010476221B2

(12) United States Patent
Yamamizu et al.

(10) Patent No.: US 10,476,221 B2
(45) Date of Patent: Nov. 12, 2019

(54) POWER SUPPLY SOCKET FOR HALOGEN LAMP, AND HALOGEN LAMP

(71) Applicants: Ushio Lighting, Inc., Tokyo (JP); CE-RISE Co., Ltd., Tokyo (JP)

(72) Inventors: Yutaka Yamamizu, Tokyo (JP); Toshifumi Motoyama, Tokyo (JP); Tsuyoshi Takeya, Tokyo (JP)

(73) Assignees: Ushio Lighting, Inc., Tokyo (JP); CE-RISE Co., Ltd., Tokyo (JP)

( * ) Notice: Subject to any disclaimer, the term of this patent is extended or adjusted under 35 U.S.C. 154(b) by 0 days.

(21) Appl. No.: 16/258,812

(22) Filed: Jan. 28, 2019

(65) Prior Publication Data

US 2019/0237925 A1 Aug. 1, 2019

(30) Foreign Application Priority Data

Jan. 30, 2018 (JP) ..... 2018-014050

(51) Int. Cl.

| | |
|---|---|
| ***H01R 33/94*** | (2006.01) |
| ***H01K 1/18*** | (2006.01) |
| ***H01K 1/28*** | (2006.01) |
| ***H01R 33/05*** | (2006.01) |
| ***F21V 14/02*** | (2006.01) |
| ***F21V 19/00*** | (2006.01) |
| ***H01K 1/44*** | (2006.01) |

(52) U.S. Cl.

CPC ..... *H01R 33/94* (2013.01); *F21V 14/02* (2013.01); *F21V 19/0065* (2013.01); *H01K 1/18* (2013.01); *H01K 1/28* (2013.01); *H01K 1/44* (2013.01); *H01R 33/05* (2013.01); *H01R 2201/08* (2013.01)

(58) Field of Classification Search

CPC ..... H01R 33/94; H01R 33/05; F21V 14/02; F21V 19/0065; H01K 1/18; H01K 1/28; H01K 1/44

See application file for complete search history.

(56) References Cited

U.S. PATENT DOCUMENTS 3,517,372 A * 6/1970 Wierzbicki ..... H01J 5/56 439/366
2006/0056183 A1* 3/2006 Yamamizu ..... H01K 1/18 362/294

(Continued)

FOREIGN PATENT DOCUMENTS

JP 2000-138170 A 5/2000

*Primary Examiner* — Tho D Ta
*Assistant Examiner* — Nader J Alhawamdeh
(74) *Attorney, Agent, or Firm* — Studebaker & Brackett PC

(57) ABSTRACT

To provide a socket for a halogen lamp, which allows easy attachment and removal operations, as well as enables stable contact between a lamp terminal and an external electrode terminal when the lamp is attached. The socket includes a first holder part having a first hole, a second holder part having a second hole, and a spring member accommodated at a position between the first hole and the second hole and having a third hole. The first hole, second hole, and third hole have a shape extending in a direction that is different from a direction in which the terminal is passed through. The terminal is turned after being passed through the holes, whereby the terminal moves inside the first hole, second hole, and third hole, and is fixed when the terminal reaches an outer edge portion of the third hole of the spring member.

6 Claims, 9 Drawing Sheets

(56) References Cited

U.S. PATENT DOCUMENTS

| | | | | |
|---|---|---|---|---|
| 2012/0044697 | A1* | 2/2012 | Yamamizu | H01K 1/14<br>362/296.09 |
| 2012/0049720 | A1* | 3/2012 | Yamamizu | H01K 1/18<br>313/318.01 |

* cited by examiner

POWER SUPPLY SOCKET FOR HALOGEN LAMP, AND HALOGEN LAMP

BACKGROUND OF THE INVENTION

Field of the Invention

The present invention relates to a power supply socket for a halogen lamp, and a halogen lamp having the same.

Description of the Related Art

A heating device having a large number of halogen lamps mounted thereon has been conventionally used for semiconductor wafers (see, for example, Patent Document 1).

PRIOR ART DOCUMENT

Patent Document
Patent Document 1: JP-A-2000-138170

BRIEF SUMMARY OF THE INVENTION

Conventional halogen lamps are of the type having terminals inserted (thrust) straight into holes of a power supply socket. The terminals of the lamp are thus contacted with terminals provided at the bottom of the holes of the power supply socket for connection with external electrodes, whereby electrical connection is established.

Halogen lamps used for heating of semiconductor wafers sometimes reach a high temperature of 1000° C. or more, because of which they have a shorter life than lamps for illumination applications and are replaced more frequently. In replacing lamps, an operation of pulling the terminals straight out from the power supply socket is necessary. This pulling action requires a considerable force. This is because the lamp is configured to be not readily disconnected for the purpose of ensuring stable contact between external electrode terminals and the lamp terminals. Easily detachable halogen lamps may go off during use, and this leads to uneven heating.

A device for heating semiconductor wafers includes several tens or more of halogen lamps, sometimes more than a hundred halogen lamps. Replacement of halogen lamps therefore requires operation of pulling the terminals of halogen lamps out of the power supply sockets with a considerable force, causing a large burden.

Moreover, when the lamp is of the conventional type with terminals inserted linearly into the power supply socket, it is not possible to visually confirm that tips of the terminals have reached straight to the deep end of the holes of the socket since the socket part is narrow and dark inside. Therefore, when attaching the halogen lamp, an operator recognizes that the tips of the linearly inserted terminals have come to contact with the bottom of the holes in the socket only when the halogen lamp is forcefully pushed in and a reaction force from the bottom is felt. There is a possibility that the halogen lamp receives an excessive force during this operation and suffers a break or crack.

Depending on the operator, some of the halogen lamps may fail to be completely inserted to the end of the holes. When this is the case, there could be a difference in contact area between the external electrode terminals linearly disposed inside the socket and the terminals of the halogen lamp, i.e., a difference in the state of electrical connection, among the halogen lamps. This will lead to a difference in generated heat among the halogen lamps, which could cause uneven heating of wafers.

In view of the problems described above, an object of the present invention is to provide a power supply socket for a halogen lamp, which allows easy attachment and removal operations, as well as enables stable contact between a lamp terminal and an external electrode terminal when the lamp is attached. Another object of the present invention is to provide a halogen lamp having such a power supply socket.

A power supply socket of the present invention allows electrical connection with a terminal of a halogen lamp when the terminal is inserted therein. The power supply includes:

a first holder part having a first hole that allows the terminal to pass through;

a second holder part having a second hole formed at a position where the terminal that has passed through the first hole can be inserted; and a spring member accommodated at a position between the first hole and the second hole and having a third hole that allows the terminal to pass through, the first hole, the second hole, and the third hole having a shape extending in a direction that is different from a direction in which the terminal is inserted or passed through, the terminal being turned after being inserted into the second hole, whereby the terminal moves inside the first hole, the second hole, and the third hole, and is fixed when the terminal reaches an outer edge portion of the third hole of the spring member.

This configuration enables mounting of the terminal to the power supply socket by rotating the halogen lamp including the terminal in a direction different from a direction to which the terminal is passed through. When the terminal reaches the outer edge portion of the third hole of the spring member, a reaction force resulting from the biasing force of the spring member is generated, which allows the operator to know that the terminal has been mounted correctly. This reduces the possibility of a difference being present in the state of contact between lamp terminals and external electrode terminals among the halogen lamps. Thus, in wafer heating applications, the use of this halogen lamp in large numbers can minimize unevenness in the heating.

Since the halogen lamp is not of the conventional type, which has terminals inserted straight into the power supply socket as the halogen lamp itself is linearly pushed in, it takes less force to cause the lamp to reach a correct installation position, so that the terminal of the halogen lamp can be correctly contacted with the external electrode terminal inside the power supply socket irrespective of the difference in operator's force that varies among individuals. Also, since it is unlikely that the halogen lamp receives an excessive force when attached, there is less possibility that the tube body suffers a break or crack during the attachment.

The terminal may include a first terminal portion, a constricted portion with a smaller diameter than that of the first terminal portion, and a second terminal portion with a larger diameter than that of the constricted portion, these being continuously formed along an axial direction, and the third hole of the spring member may have a shape including a first region with a larger hole diameter than the diameter of the first terminal portion, and a second region communicated with the first region and having a hole diameter that is larger than the diameter of the constricted portion and smaller than the diameters of the first terminal portion and the second terminal portion.

According to this configuration, the terminal of the halogen lamp, when inserted into the power supply socket, passes through the third hole of the spring member. After the terminal has been turned from the first region to the second region of the third hole, the terminal can no longer be pulled out from the third hole, because the first terminal portion and the second terminal portion on both sides of the constricted portion have larger diameters than the hole diameter of the third hole in the second region. The terminal thus turns stably inside the third hole of the spring member. When the constricted portion of the terminal has reached the outer edge portion of the third hole in the second region, the first terminal portion and the second terminal portion come to positions where they sandwich a portion of the spring member that forms this outer edge portion. This allows a biasing force of the spring member to act on the terminal, so that the terminal is securely attached to the power supply socket.

The second holder part may include an external electrode terminal on a surface opposite from an open side of the second hole.

A halogen lamp of the present invention include the power supply socket and the terminal.

According to the present invention, a power supply socket for a halogen lamp, which allows easy attachment and removal operations, as well as enables stable contact between a lamp terminal and an external electrode terminal when the lamp is attached, and a halogen lamp having the socket, are realized.

DETAILED DESCRIPTION OF THE INVENTION

Figure 1:
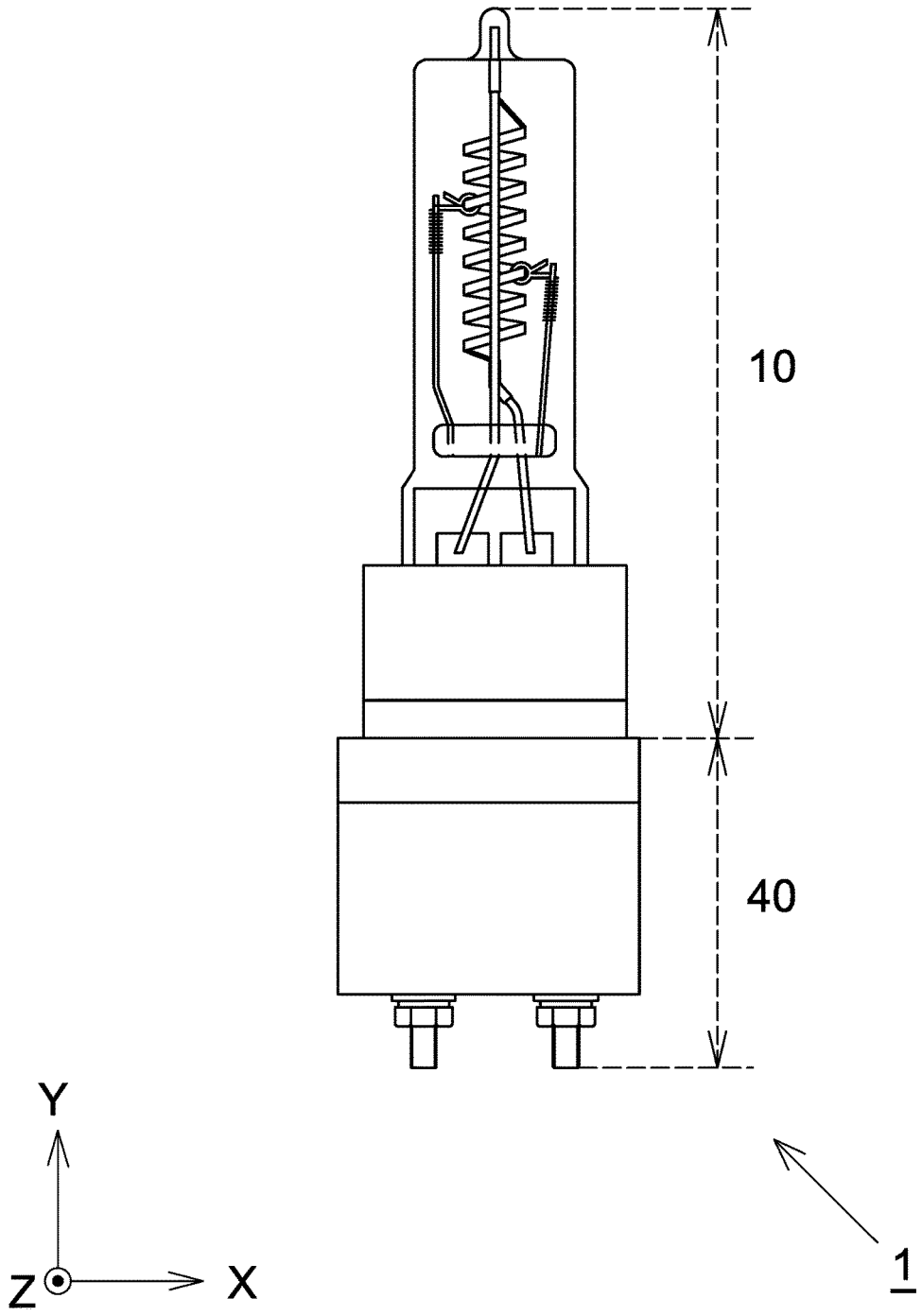
FIG. 1 is a front view schematically showing a structure of a halogen lamp.

A power supply socket for a halogen lamp, and the halogen lamp according to the present invention will be hereinafter described with reference to the drawings. The drawings provide schematic illustrations and the dimensional ratios in the drawings are not necessarily the same as the actual dimensional ratios. The dimensional ratios of the drawings in various figures are not necessarily the same.

[Structure]

FIG. 1 is a front view schematically showing a structure of a halogen lamp. As shown in FIG. 1, a halogen lamp 1 includes a lamp body 10 and a power supply socket 40. FIG. 1 shows a state where the lamp body 10 is attached to the power supply socket 40.

(Lamp Body 10)

Figure 2:
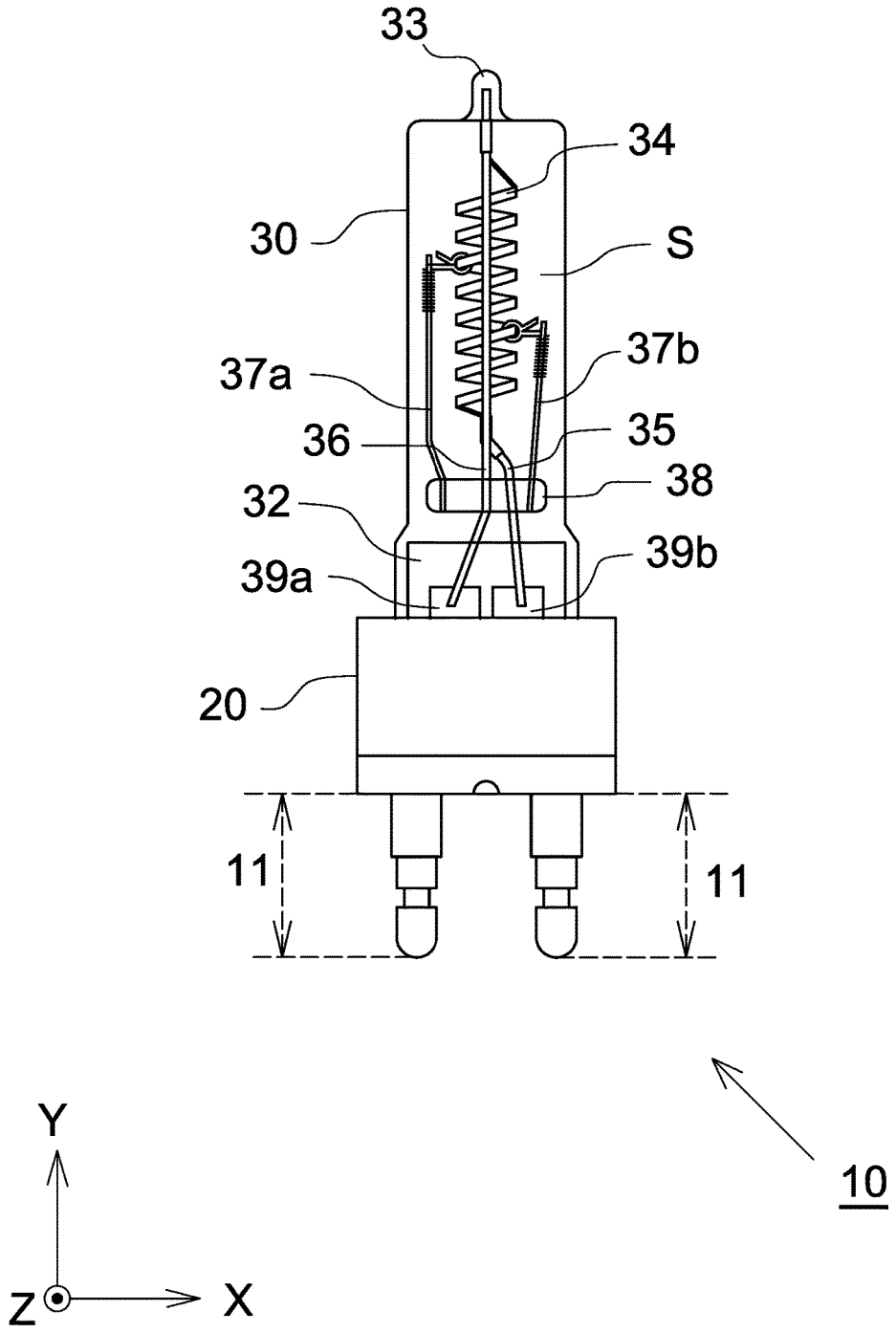
FIG. 2 is a front view schematically showing a structure of a lamp body when detached from a socket.

FIG. 2 is a front view schematically showing a structure of the lamp body 10 when it is detached from the power supply socket 40. The lamp body 10 includes terminals 11 mounted to the power supply socket 40, a bulb 30 that forms a light emitting space, and a base part 20 that connects the bulb 30 with the terminals 11.

The bulb 30 is a tubular body including a sealed part 32 at one end where a pair of metal foils 39*a* and 39*b* is embedded, and a discharge tube remaining part 33 at the other end, and is made of silica glass, for example. The bulb 30 includes a filament 34 disposed inside the tubular body such as to extend along an axial direction of the bulb 30.

The filament 34 is a double coil, which is formed by a tungsten strand wire, for example, wound around a primary coil, which is once more wound around into a secondary coil. In another example, the filament 34 is a single coil formed by a tungsten strand wire wound around a primary coil.

The bulb 30 includes, inside the tubular body, a first inner lead 35 having one end connected to an end of the filament 34 on the side closer to the sealed part 32 and the other end connected to the metal foil 39*b*. The bulb 30 includes, inside the tubular body, a second inner lead 36 having one end connected to an end of the filament 34 on the side closer to the discharge tube remaining part 33 and the other end connected to the metal foil 39*a*.

The bulb 30 includes, inside the tubular body, a pair of supporters (37*a*, 37*b*) disposed opposite each other on both sides of the filament 34 to hold the filament 34, and an insulating member 38 for securing insulation between the inner leads (35, 36).

The bulb 30 forms a light emitting space S inside the tubular body. The light emitting space S is filled with an inert gas such as nitrogen for example, as well as halogen gas for performing a halogen cycle.

The base part 20 is made of an insulating material such as alumina for example, and includes a bottomed hole (not shown) in one of its surfaces (surface closer to the bulb 30) for the sealed part 32 of the bulb 30 to be inserted. With the sealed part 32 inserted into this bottomed hole, the base part 20 and the bulb 30 are integrally fixed together. As shown in FIG. 2, the terminal 11 for supplying power to the filament 34 sticks out from the surface of the base part 20 opposite from the bulb 30.

The terminals 11 are provided in pair, one being electrically connected to the metal foil 39*a*, and the other being electrically connected to the metal foil 39*b*. As will be described later, power is supplied to the filament 34 via the terminals 11 from outside when the terminals 11 are attached to the power supply socket 40.

Figure 3A:
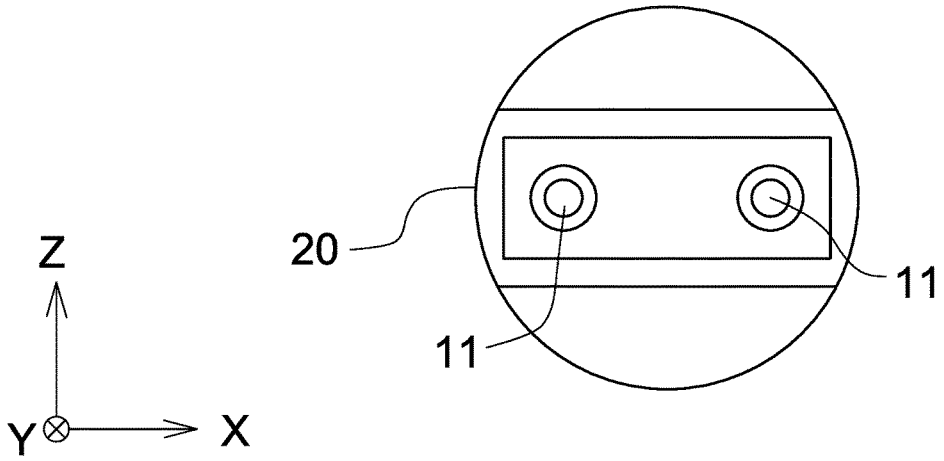
FIG. 3A is a plan view of a base part as seen from a terminal side.
Figure 3B:
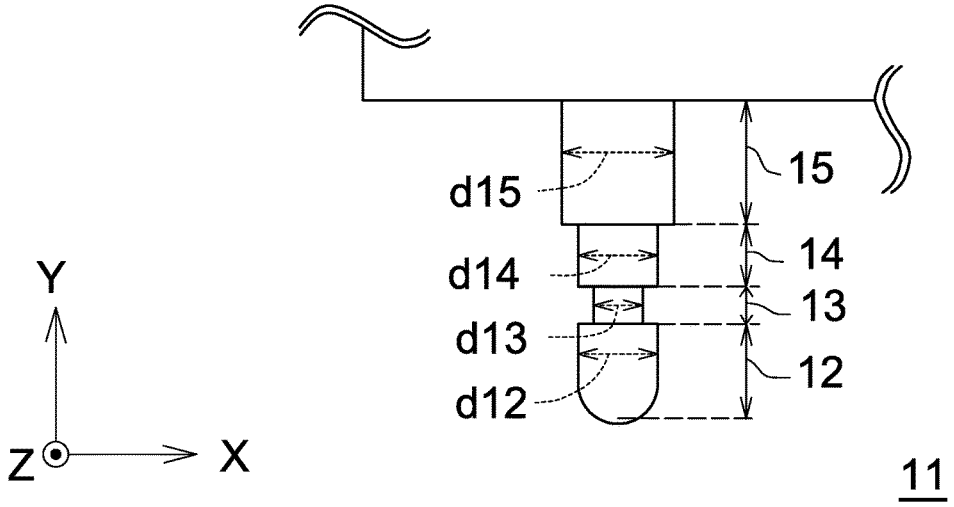
FIG. 3B is an enlarged view of a terminal part of FIG. 2.

FIG. 3A and FIG. 3B are enlarged views of the vicinity of the terminals 11. FIG. 3A is a plan view of the base part 20 shown in FIG. 2 as viewed from the terminals 11 side (Y direction). FIG. 3B is an enlarged view of part of the terminal 11 in FIG. 2.

The terminal 11 has a first terminal portion 12, a constricted portion 13 having a smaller diameter than that of the first terminal portion 12, and a second terminal portion 14 having a larger diameter than that of the constricted portion 13, these being continuously formed along the axial direction (Y direction). In the structure shown in FIG. 3B, the terminal 11 further has a third terminal portion 15 having a larger diameter than that of the second terminal portion 14. A diameter d12 of the first terminal portion 12 is larger than a diameter d13 of the constricted portion 13 (d12>d13), the diameter d13 of the constricted portion 13 is smaller than a diameter d14 of the second terminal portion 14 (d13<d14), and the diameter d14 of the second terminal portion 14 is smaller than a diameter d15 of the third terminal portion 15 (d14<d15).

The first terminal portion 12 forms a tip of the terminal 11 and is located farthest from the base part 20. The third terminal portion 15 of the terminal 11 is located closest to the base part 20.

The terminal 11 need not necessarily include the third terminal portion 15.

Namely, the second terminal portion 14 may be located closest to the base part 20.

(Power Supply Socket 40)

Figure 4:
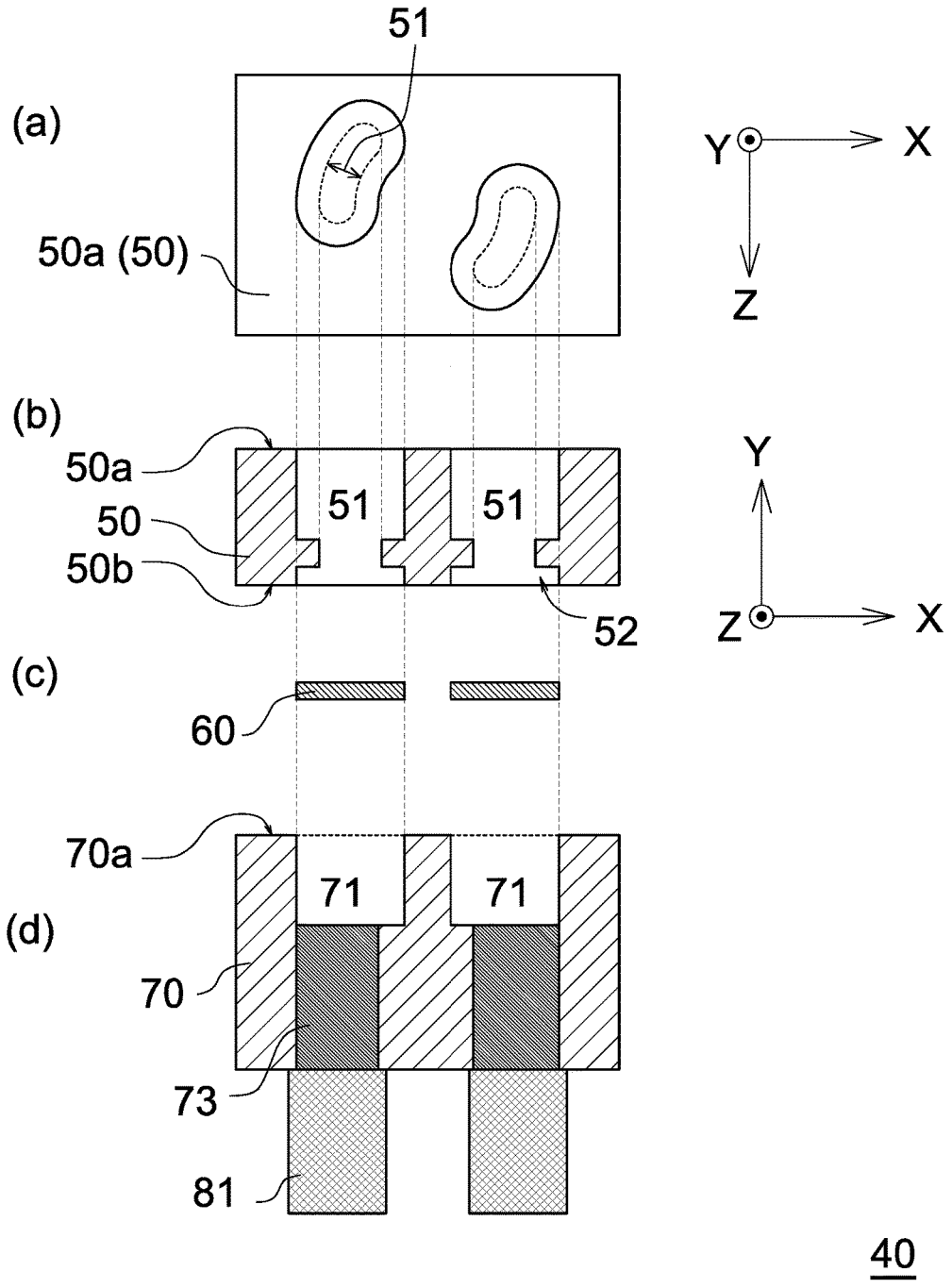
FIG. 4 is a view schematically showing a structure of a power supply socket.

FIG. 4 is a view schematically showing a structure of the power supply socket 40. The power supply socket 40 includes a first holder part 50, a second holder part 70, and spring members 60 interposed between the first holder part 50 and the second holder part 70. With the power supply socket 40 being attached to the lamp body 10, the first holder part 50 is located closest to the lamp body 10, while the second holder part 70 is located farther from the lamp body 10 than the first holder part 50.

In FIG. 4, (b) shows a schematic cross-sectional view of the first holder part 50, (c) shows a schematic cross-sectional view of the spring members 60, and (d) shows a schematic cross-sectional view of the second holder part 70. In FIG. 4, (a) corresponds to a schematic plan view of the first holder part 50 as viewed from above. The illustrations (a) to (d) of FIG. 4 are all aligned at the same position in the X direction.

Figure 5A:
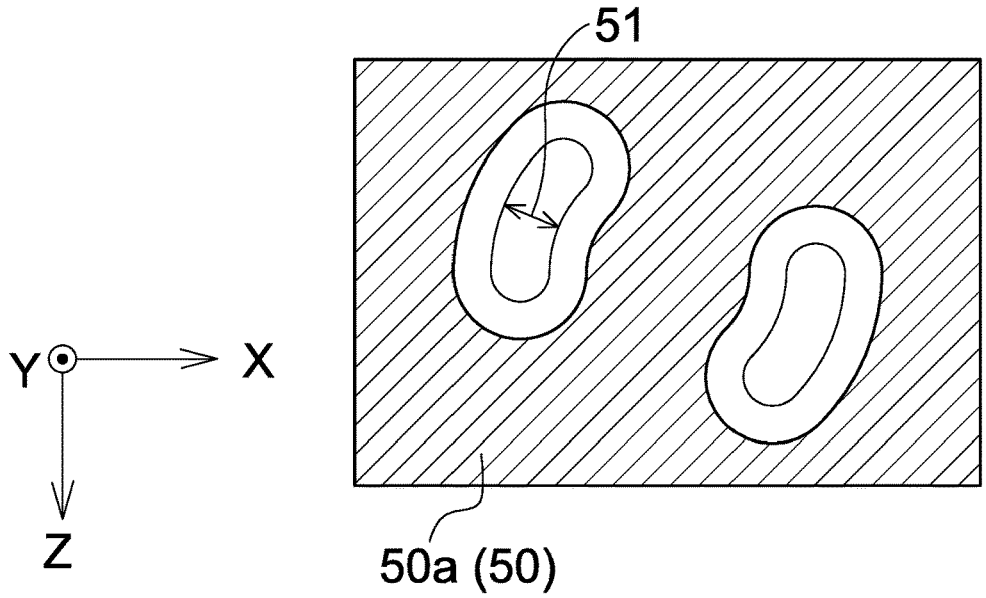
FIG. 5A is a schematic plan view of a first holder part as viewed from above.
Figure 5B:
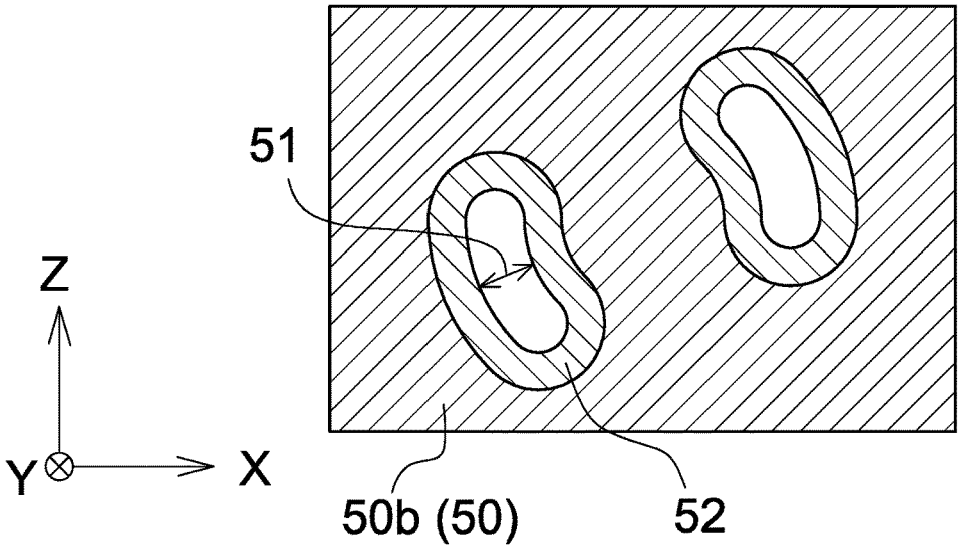
FIG. 5B is a schematic plan view of the first holder part as viewed from an opposite side from FIG. 5A.

The first holder part 50 has first holes 51 formed such as to allow the terminals 11 to pass through in the Y direction. FIG. 5A is a figure illustrating the first holder part 50 as viewed from above as with FIG. 4(*a*) and shows a surface 50*a* on the side closer to the lamp body 10. FIG. 5B is a schematic plan view of the first holder part 50 as viewed from the opposite side from FIG. 5A, and shows a surface 50*b* on the far side from the lamp body 10.

As shown in FIG. 4, FIG. 5A, and FIG. 5B, the first holes 51 extend through the first holder part 50 in the Y direction, and are extended in the X-Z plane directions. The first holder part 50 includes spring accommodating parts 52 in the surface 50*b*, formed in communication with the first holes 51.

Figure 6A:
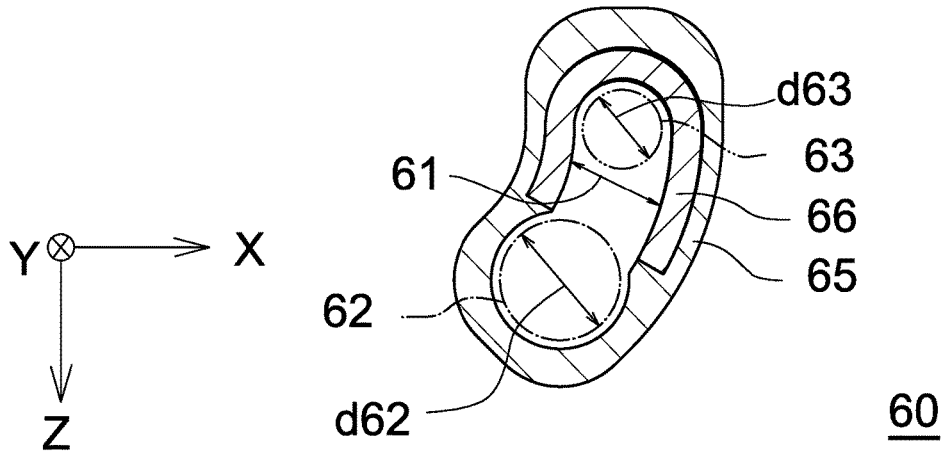
FIG. 6A is a schematic plan view of a spring member.
Figure 6B:
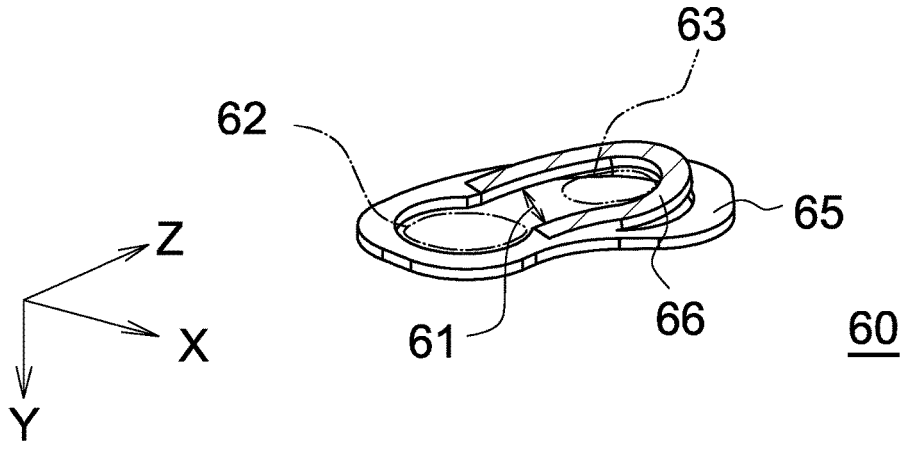
FIG. 6B is a schematic perspective view of the spring member.

FIG. 6A is a schematic plan view of the spring member 60. FIG. 6B is a schematic perspective view of the spring member 60. The spring member 60 includes a first portion 65 having a surface parallel to the X-Z plane, and a second portion 66 formed to incline in the Y direction from the first portion 65, these being continuously formed. The first portion 65 and the second portion 66 are both formed with a hole (open region) inside. The first portion 65 has a shape corresponding to that of the spring accommodating part 52 of the first holder part 50.

The second portion 66 is formed such as to fit with the inner side of an outer edge portion of the hole in the first portion 65 when pressed in the Y direction. FIG. 6A is therefore also a figure that shows a state where the second portion 66 is fitted in the hole in the first portion 65. Hereinafter, the hole formed in the spring member 60 will be referred to as a "third hole 61".

The third hole 61 is formed to allow the terminal 11 to pass through in the Y direction and extended in the X-Z plane. This third hole 61 is formed by a first region 62 and a second region 63 communicated with each other. The first region 62 has a hole diameter d62 that is larger than the diameter d12 of the first terminal portion 12 and the diameter d14 of the second terminal portion 14. The second region 63 has a hole diameter d63 that is larger than the diameter d13 of the constricted portion 13 but smaller than the diameter d12 of the first terminal portion 12 and the diameter d14 of the second terminal portion 14.

As shown in FIG. 4(*d*), the second holder part 70 has second holes 71 bored in the Y direction to a depth not extending through the second holder part 70. The second holder part 70 includes external electrode terminals 73 formed on the opposite side from the open side of the second holes 71, and connection terminals 81 electrically connected to the external electrode terminals 73. The connection terminals 81 are connected to a power supply circuit that is not shown.

The second hole 71 has a shape corresponding to that of the first hole 51 of the first holder part 50 and the third hole 61 of the spring member 60. The second hole 71 is formed to allow the terminal 11 to be inserted in the Y direction and extended in the X-Z plane.

In the power supply socket 40, the surface 50*b* of the first holder part 50 is in contact with the surface 70*a* of the second holder part 70, with the spring members 60 being accommodated inside the spring accommodating parts 52 of the first holder part 50. In this state, the first holes 51 of the first holder part 50, the third holes 61 of the spring members 60, and the second holes 71 of the second holder part 70 are communicated with each other in the Y direction.

[Attachment Method]

When attaching the lamp, an operator inserts the terminals 11 of the lamp body 10 into the first holes 51 from the surface 50*a* side of the first holder part 50. The terminals 11 are inserted in the Y direction until their tips pass through the third holes 61 of the spring members 60 and the second holes 71 of the second holder part 70 and contact the bottom surface of the second holes 71.

Figure 7:
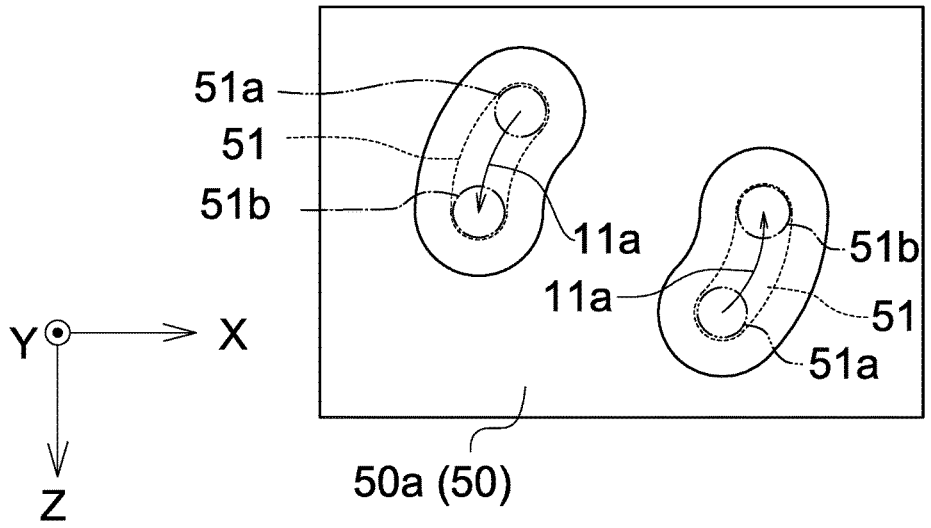
FIG. 7 is a schematic plan view of the first holder part as seen from above, with an indication of a moving direction of the terminal.

In this state, the operator turns the terminals 11 in respective holes (51, 61, and 71). More specifically, after inserting the terminals 11 in regions 51*a* of the first holes 51 of the first holder part 50, the operator turns the terminals in the direction of arrows 11*a* toward regions 51*b* (see FIG. 7). The terminals 11 at this time are turned from the first region 62 with a larger hole diameter toward the second region 63 with a smaller hole diameter in the third holes 61 of the spring members 60 (see FIG. 6A and FIG. 6B).

As mentioned above, the hole diameter d63 of the second region 63 is larger than the diameter d13 of the constricted portion 13 but smaller than the diameter d12 of the first terminal portion 12 and the diameter d14 of the second terminal portion 14. Therefore, as the terminals 11 turn inside the third holes 61 of the spring members 60, a boundary face between the first terminal portion 12 and the constricted portion 13, or a boundary face between the second terminal portion 14 and the constricted portion 13, moves along an inner surface of the second portion 66 of the spring members 60.

Figure 8:
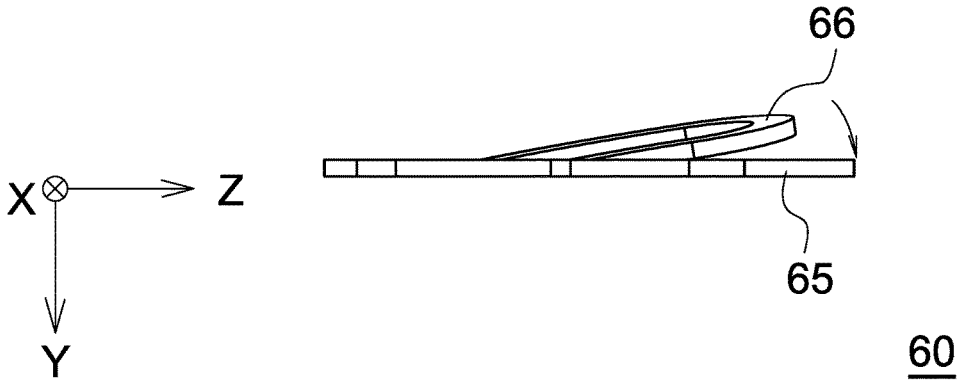
FIG. 8 is a schematic front view of the spring member.

When the terminals 11 have come to the regions 51*b* inside the first holes 51 of the first holder part 50, the terminals 11 reach outer edge portions of the second regions 63 in the third holes 61 of the spring members 60. The terminals 11 at this time press the second portions 66 of the spring members 60 toward the first portions 65 (see the arrow in FIG. 8). This results in a biasing force acting from the first portions 65 toward the second portions 66, whereby the terminals 11 are retained. The operator can realize that the terminals 11 have been mounted to the power supply socket 40 correctly by feeling the reaction force caused by this biasing force.

Other Embodiments

Other embodiments will be described below.

Figure 9A:
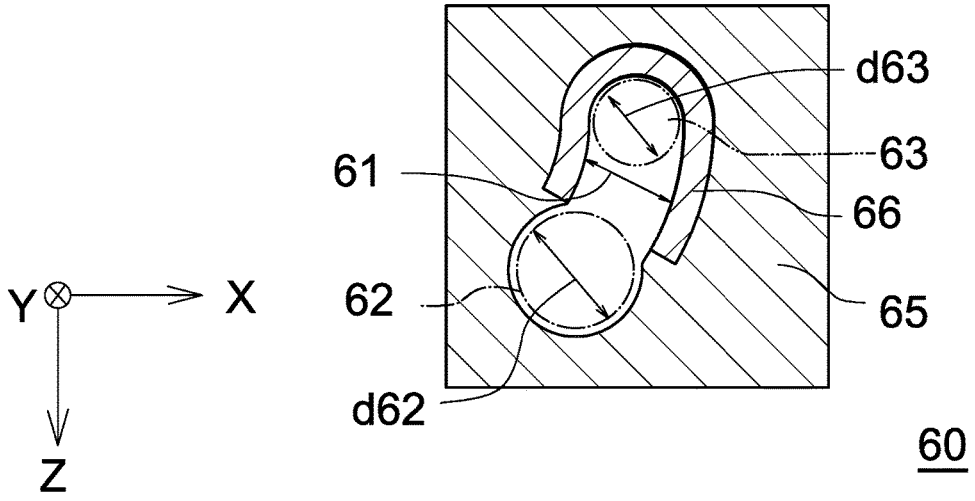
FIG. 9A is another schematic plan view of the spring member.
Figure 9B:
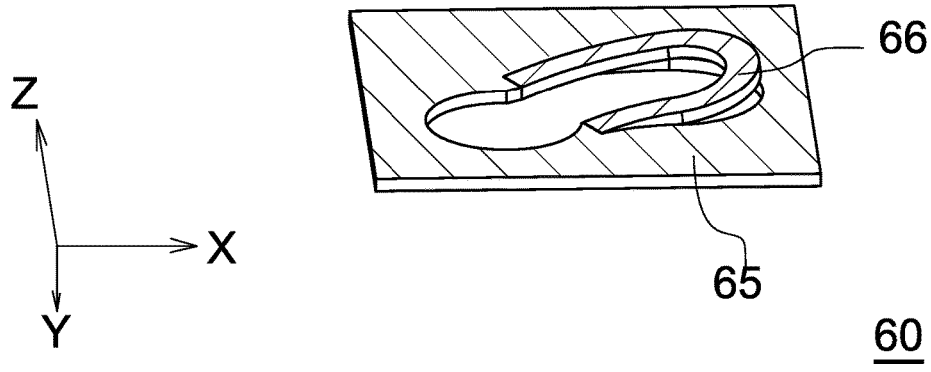
FIG. 9B is a schematic plan view of the spring member shown in FIG. 9A.
Figure 10:
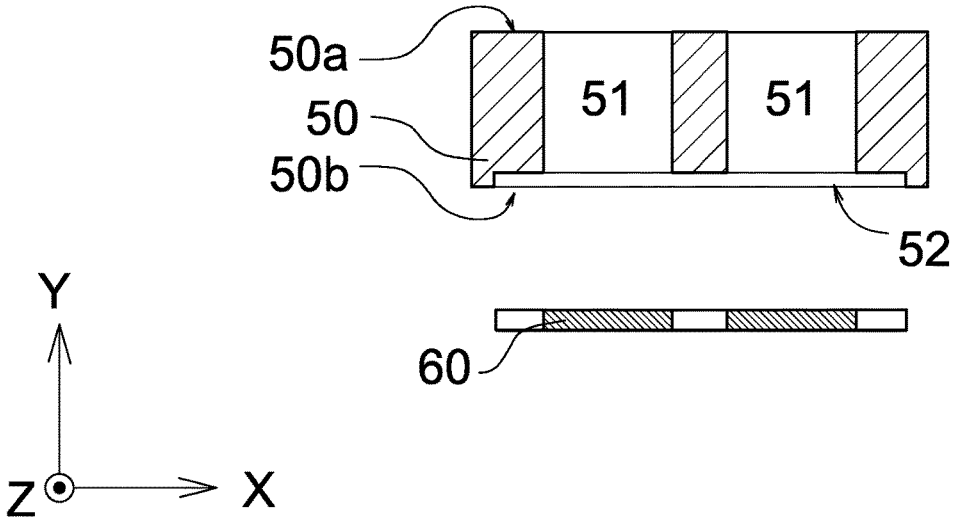
FIG. 10 is a schematic cross-sectional view of the spring member shown in FIG. 9A and the first holder part associated with this spring member.

<1> The first portion 65 of the spring member 60 may be formed in a quadrate shape. FIG. 9A is a schematic plan view of the spring member 60 of this alternative embodiment, and FIG. 9B is a schematic perspective view of the spring member 60 of this alternative embodiment. FIG. 10 shows a cross section of the first holder part 50 with the spring member 60 of this alternative embodiment, and of the spring member 60, similarly to FIG. 4. As compared to FIG. 4, the spring accommodating part 52 of the first holder part 50 has a shape conforming to the shape of the first portion 65 of the spring member 60.

<2> While the hole diameter d62 of the first region 62 in the third hole 61 of the spring member 60 was described to be larger than the diameter d12 of the first terminal portion 12 and the diameter d14 of the second terminal portion 14 in the embodiment described above, the hole diameter d62 only needs to be larger than at least the diameter d12 of the first terminal portion 12.

If the hole diameter d62 of the first region 62 of the spring member 60 is smaller than the diameter d14 of the second terminal portion 14, when the terminals 11 are inserted into respective holes (51, 61, 71) from the surface 50*a* side of the first holder part 50, the constricted portions 13 pass through the third holes 61 of the spring members 60, while the second terminal portions 14 cannot pass through the third holes 61 of the spring members 60. Namely, the terminals 11 are stopped from further moving in when the first terminal portions 12 and constricted portions 13 of the terminals 11 come to position below the third holes 61 (on the side facing the second holder part 70), and the second terminal portions 14 and portions of the second terminal portions 14 closer to the base part 20 come to position above the third holes 61.

When the terminals 11 are turned toward the region 51*b* (see FIG. 7) in this state, the boundary surface between the first terminal portion 12 and the constricted portion 13, or the boundary surface between the second terminal portion 14 and the constricted portion 13, of the terminals 11, moves along the inner surface of the second portion 66 of the spring members 60, because the hole diameter d63 of the second region 63 is larger than the diameter d13 of the constricted portion 13 but smaller than the diameter d12 of the first terminal portion 12 and the diameter d14 of the second terminal portion 14, as with the previously described embodiment. Accordingly, similarly to the previously described embodiment, when the terminals 11 have reached outer edge portions of the second region 63 of the third holes 61 of the spring members 60, a biasing force acts from the first portions 65 toward the second portions 66, whereby the terminals 11 are fixed.

What is claimed is:

1. A power supply socket allowing electrical connection with a terminal of a halogen lamp when the terminal is inserted therein, the power supply socket comprising:

a first holder part having a first hole that allows the terminal to pass through;

a second holder part having a second hole formed at a position where the terminal that has passed through the first hole can be inserted; and a spring member accommodated at a position between the first hole and the second hole and having a third hole that allows the terminal to pass through, the first hole, the second hole, and the third hole having a shape extending in a direction that is different from a direction in which the terminal is inserted or passed through, the terminal being turned after being inserted into the second hole, whereby the terminal moves inside the first hole, the second hole, and the third hole, and is fixed when the terminal reaches an outer edge portion of the third hole of the spring member.

2. The power supply socket according to claim 1, wherein the terminal includes a first terminal portion, a constricted portion with a smaller diameter than that of the first terminal portion, and a second terminal portion with a larger diameter than that of the constricted portion, these being continuously formed along an axial direction, and the third hole of the spring member has a shape including a first region with a larger hole diameter than the diameter of the first terminal portion, and a second region communicated with the first region and having a hole diameter that is larger than the diameter of the constricted portion and smaller than the diameters of the first terminal portion and the second terminal portion.

3. The power supply socket according to claim 2, wherein the second holder part includes an external electrode terminal on a surface opposite from an open side of the second hole.

4. A halogen lamp comprising the power supply socket according to claim 1, and the terminal.

5. A halogen lamp comprising the power supply socket according to claim 2, and the terminal.

6. A halogen lamp comprising the power supply socket according to claim 3, and the terminal.

* * * * *